US005207070A

United States Patent [19]

Miyazaki

[11] Patent Number: 5,207,070

[45] Date of Patent: May 4, 1993

[54] AIR CONDITIONER

[75] Inventor: Koichi Miyazaki, Shizuoka, Japan

[73] Assignee: Kabushiki Kaisha Toshiba, Kawasaki, Japan

[21] Appl. No.: 722,225

[22] Filed: Jun. 27, 1991

[30] Foreign Application Priority Data

Jun. 28, 1990 [JP] Japan ..... 2-170689

[51] Int. Cl.[5] ..... F25B 13/00

[52] U.S. Cl. ..... 62/160; 62/175; 165/22

[58] Field of Search ..... 62/160, 175; 237/2 B; 165/22

[56] References Cited

FOREIGN PATENT DOCUMENTS 0082638 5/1982 Japan ..... 165/22
62-134437 6/1987 Japan .
62-162834 7/1987 Japan .
0248948 10/1987 Japan ..... 165/22

*Primary Examiner*—William E. Wayner
*Attorney, Agent, or Firm*—Foley & Lardner

[57] ABSTRACT

In an air conditioner having a single outdoor unit and a plurality of indoor units, if at least two indoor units supply operation commands, an indoor unit allowed to be operated and an indoor unit not allowed to be operated are determined in accordance with a predetermined operation priority order. An operation standby signal is sent to the indoor unit not allowed to be operated. If the indoor unit allowed to be operated stops its operation, a new indoor unit is determined by again referring to the operation priority order. A confirmation signal is then sent to the determined new indoor unit under the standby state until then. If the indoor unit received the confirmation signal sends a response signal indicating that the indoor unit still intends to operate, then an operation permission signal is given to the new indoor unit.

8 Claims, 5 Drawing Sheets

AIR CONDITIONER

BACKGROUND OF THE INVENTION

1. Field of the Invention

The present invention relates to an air conditioner constructed of a plurality of indoor units and a single outdoor unit.

2. Description of Related Art

A so-called multi air conditioner has been developed which is constructed of a plurality of indoor units each installed within a room, and a single outdoor unit. Such a multi air conditioner is provided with a refrigerating cycle including a compressor, an outdoor heat exchanger, a plurality of indoor heat exchangers, and the like. The compressor and outdoor heat exchanger are collectively installed as an outdoor unit. A plurality of indoor heat exchangers are each collectively installed as an independent indoor unit. Since the multi air conditioner has only one outdoor unit, each indoor unit cannot run in a different operation mode. For example, if a heat operation command from the controller of an indoor unit of room A and a cool operation command from the controller of an indoor unit of room B are supplied at the same time to the controller of the outdoor unit, the multi air conditioner of the type described above cannot deal with both the operation commands.

In anticipation of such a case, a conventional multi air conditioner of this type has been provided with the following control method. Namely, the priority order of operation modes for an air conditioner is determined in advance (such as in the order of heat, cool, and blow), and an operation permission command is returned back to an indoor unit which sends an operation command representative of an operation mode having the highest priority order.

If the operation mode of the multi air conditioner system is controlled by the above-described control method, indoor units other than the indoor unit having the highest operation priority enter an operation inhibition (standby) state. When the highest operation mode is cancelled (e.g., when the indoor unit assigned the highest priority stops its operation, or when it selects a lower priority operation mode), one of the other indoor units having the highest priority order at that time is selected and an operation permission signal is sent. Then, the operation mode of the multi air conditioner system changes to the operation mode designated by the indoor unit given the operation permission signal.

The time when the indoor unit having the highest priority order at the first time cancels the operation mode, corresponds to the time when an operator manipulates an operation stop key or an operation mode setting key. If the indoor unit operating under the highest priority mode cancels the mode after a long time from when a certain indoor unit sets an operation mode, the set operation mode may sometimes be improper at that time for a person in that room because of a change in room conditions. Furthermore, a person may sometimes leave the room before the indoor unit having the highest priority order cancels its operation mode. In this case, unnecessary power is consumed uneconomically. In addition, during this time period, another indoor unit cannot be operated, disabling reasonable operation of the whole system.

Furthermore, such a multi air conditioner system is designed such that the total capacity of a plurality of indoor units is larger than the capacity of an outdoor unit, because all indoor units are seldom operated at the same time. There is, however, a possibility that the total capacity of a plurality of indoor units actually exceeds the capacity of an outdoor unit. In view of this, there has been proposed an air conditioner which selectively determines indoor units to be operated in such a case (refer to Japanese Patent Laid-Open Publication No. 62-162834). According to this proposal, indoor units are selectively determined in accordance with a predetermined priority, order This conventional technique does not consider the case where system conditions change because the initially selected indoor units stop their operation, and so one or all of the other indoor units which were not permitted to be operated are allowed to start operating.

SUMMARY OF THE INVENTION

It is an object of the present invention to provide an air conditioner capable of providing a reasonable operation of the whole system while considering operation commands from indoor units as much as possible.

In order to achieve the above object of the present invention, there is provided an air conditioner having at least two indoor units and a single outdoor unit commonly used by at least two indoor units, comprising:

first means for comparing operation commands sent from the at least two indoor units with a predetermined operation priority order, determining an indoor unit group allowed to be operated, and an indoor unit group not allowed to be operated, and sending an operation permission signal to each indoor unit of the indoor unit group allowed to be operated, and an operation standby signal to each indoor unit of the indoor unit group not allowed to be operated;

second means for determining a new indoor unit allowed to be operated in an indoor unit group received the operation standby signal while referring to the operation priority order, when the operation command of at least one indoor unit of the indoor unit group received the operation permission signal sent from the first means is canceled, and sending a notice signal to the new indoor unit, the notice signal being used for confirming if the initial operation command of the new indoor unit is still effective or not;

third means for detecting a response signal sent from the new indoor unit after sending the notice signal from the second means; and fourth means for starting an operation of the new indoor unit when the response signal sent from the new indoor unit is detected by the third means.

DETAILED DESCRIPTION OF THE PREFERRED EMBODIMENT

The following description is directed to an embodiment wherein an operation priority order is determined in accordance with an operation mode.

Figure 1:
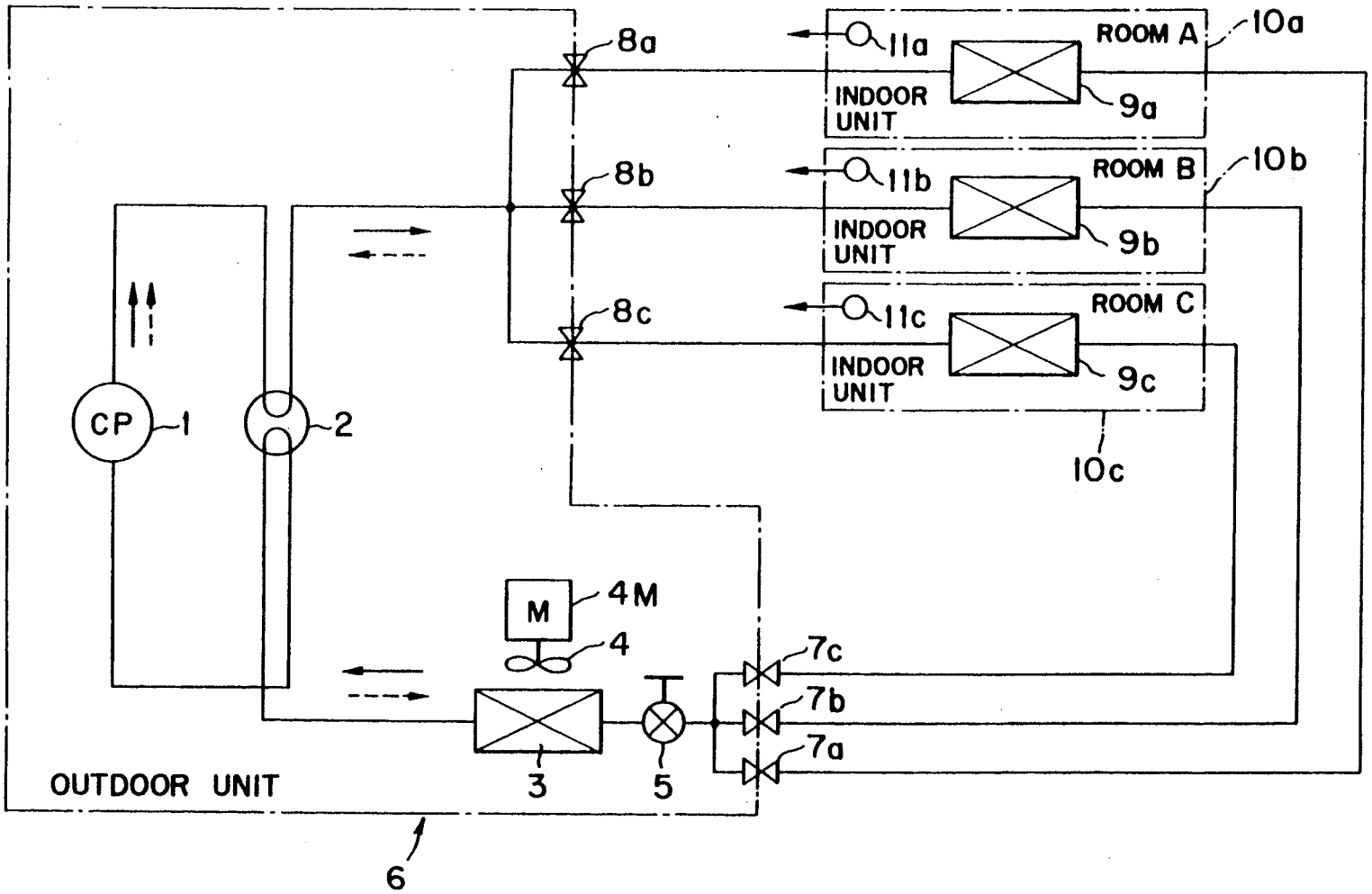
FIG. 1 is a schematic diagram showing the refrigerating cycle of an air conditioner embodying the present invention.

FIG. 1 is a system diagram of the refrigerating cycle of a so-called multi air conditioner. This refrigerating cycle has a compressor 1, a four-way valve 2, an indoor heat exchanger 3, a decompressor 5, three valves 7a, 7b, 7c, three valves 8a, 8b, 8c, and three indoor heat exchangers 9a, 9b, 9c. The outdoor heat exchanger 3 has an outdoor fan 4 which is driven by a motor M. The compressor 1, four-way valve 2, outdoor heat exchanger 3, decompressor 5, three valves 7a, 7b, 7c, and three valves 8a, 8b, 8c, constitute an outdoor unit 6. The indoor heat exchangers 9a, 9b, 9c constitute corresponding indoor units 10a, 10b, 10c. The indoor unit 10a is mounted in room A, the indoor unit 10b is mounted in room B, and the indoor unit 10c is mounted in room C. Each of indoor units has a built-in indoor controller, and the outdoor unit has a built-in controller. Each controller will be described later in detail. Rooms A, B, and C have temperature sensors 11a, 11b, 11c, respectively.

In the refrigerating cycle shown in FIG. 1, the direction of refrigerant circulation is changed by switching the four-way valve 2 in accordance with an operation mode. Specifically, in a heating operation mode, the indoor heat exchangers 9a, 9b, and 9c function as condensers, and the outdoor heat exchanger 3 functions as an evaporator. In this case, as shown by a solid line arrow, refrigerant circulates in the path from the compressor 1, and via the four-way valve 2, valves 8a, 8b, and 8c, indoor heat exchangers 9a, 9b, and 9c, valves 7a, 7b, and 7c, decompressor 5, outdoor heat exchanger 3, and four-way valve 2, and back to the compressor 1. In a cooling operation mode, the indoor heat exchangers 9a, 9b, and 9c function as evaporators, and the outdoor heat exchanger 3 functions as a condenser. In this case, as shown by a broken line arrow, refrigerant circulates in the path from the compressor 1, and via the four-way valve 2, indoor heat exchanger 3, decompressor 5, valves 7a, 7b, and 7c, indoor heat exchangers 9a, 9b, and 9c, valves 8a, 8b, and 8c, and four-way valve 2, back to the compressor 1. In either of the operation modes, the valves 7a to 7c and 8a to 8c are selectively opened so as to flow refrigerant only to an indoor unit to be operated.

Figure 2:
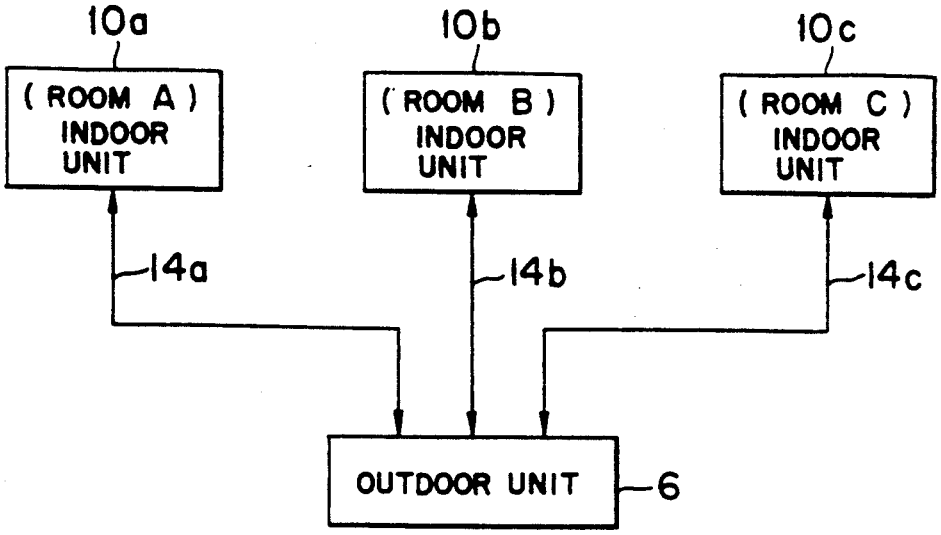
FIG. 2 is a block diagram briefly showing the overall structure of an air conditioner according to an embodiment of the present invention.

FIG. 2 is a block diagram showing the overall structure of an air conditioner according to the present invention. In FIG. 2, each of indoor units 10a, 10b, and 10c has a corresponding one of built-in indoor controllers 12a, 12b, and 12c shown in FIG. 3. An outdoor unit 6 has a built-in outdoor controller 13 shown in FIG. 3. Each of the indoor and outdoor controllers include a microcomputer. For various control data transfer, communication cables 14a, 14b, and 14c are 0 connected between the indoor units 10a, 10b, and 10c of rooms A, B, and C and the outdoor unit 6.

Figure 3:
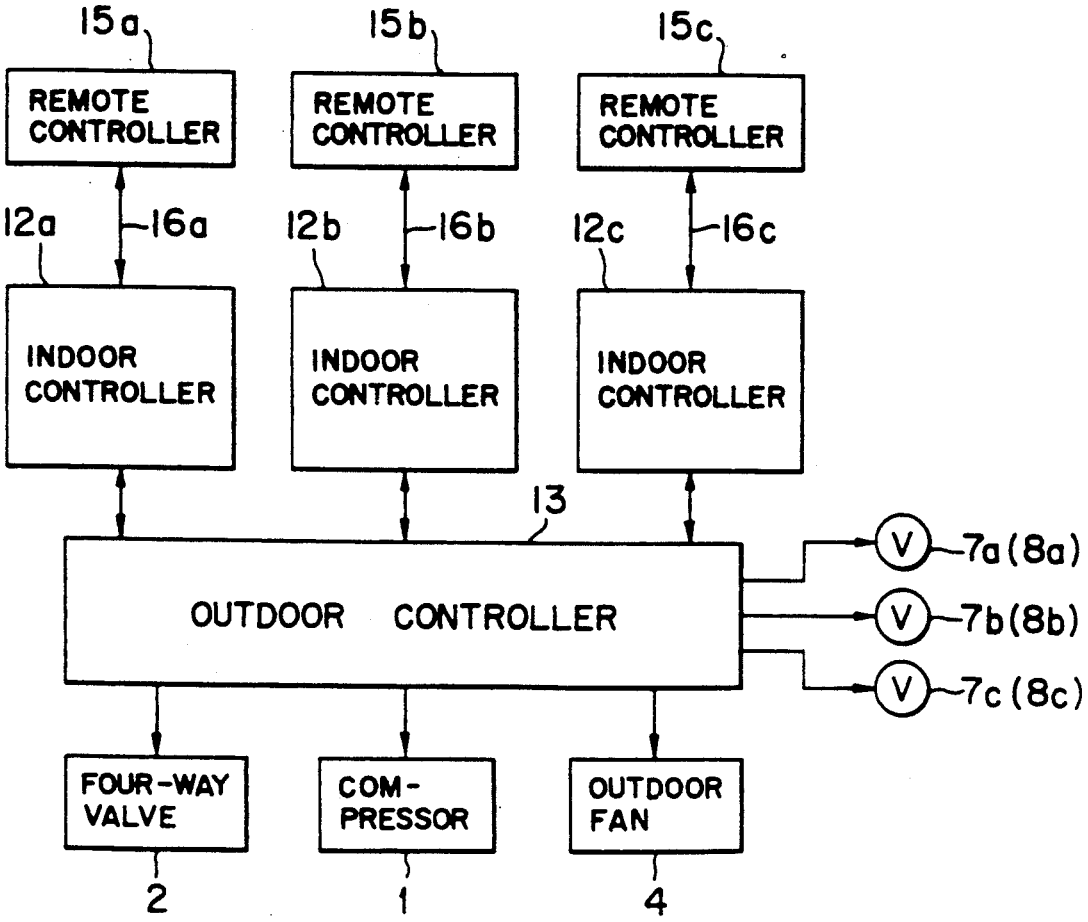
FIG. 3 is a block diagram showing the overall structure of a control system of the air conditioner according to the present invention.

FIG. 3 shows the control system of the air conditioner according to the present invention. Remote controllers 15a, 15b, and 15c are provided to the respective built-in controllers 12a, 12b, and 12c of the indoor units of rooms A, B, and C. The remote controllers and the corresponding ones of the indoor controllers are connected by communication cables 16a, 16b, and 16c, respectively. The remote controllers 15a, 15b, and 15c send an operation mode (heat, cool, blow) selection command, a room temperature setting signal, and an operation command to the corresponding ones of the indoor controllers.

Each of the indoor controllers 12a, 12b, 12c calculates a difference between a room temperature detected by a corresponding one of the temperature sensors 11a, 11b, and 11c in each room and a temperature set by a corresponding one of the remote controllers 15a, 15b, and 15c, and sends the difference to the outdoor controller 13 so as to make the former temperature become coincident with the latter temperature.

The outdoor controller 13 controls the compressor 1, four-way valve 2, outdoor fan 4, and valves 7a, 7b, 7c, 8a, 8b, and 8c all constituting the outdoor unit 6 shown in FIG. 1, and transfers various control data to and from the indoor controllers 12a, 12b, and 12c.

The outdoor controller 13 executes the following control operations and associated operations.

(1) The outdoor controller 13 stores a priority order of operation modes set by the outdoor unit 6, and the operation modes (heat, cool, or blow) manually set by an operator.

(2) The outdoor controller 13 receives operation mode selection signals sent from the indoor controllers 12a, 12b, and 12c, compares them with the predetermined operation mode priority order to determine an operation mode having a highest priority order and the corresponding indoor unit to be most preferentially operated. In response to this determination, the four-way valve 2 is switched so as to match the determined operation mode, a pair of valves corresponding to the indoor unit determined to be operated are opened, and an operation permission signal is sent to the indoor controller of the determined indoor controller. The other pairs of valves corresponding to the indoor units for which designated different operation modes are maintained closed, and an operation standby signal is sent to the indoor unit controllers.

(3) Upon reception of a command signal for stopping an operation from the indoor unit given the operation permission signal at (2), or upon reception of a signal representing that the operation mode was changed to a mode having a lower priority order, the outdoor controller 13 selects an operation mode having the next highest priority order by searching the operation mode priority order. If the indoor unit having the next highest priority order has stopped its operation for longer than a predetermined standard time period from when this indoor unit controller issue the operation command, the outdoor controller 13 then supplies a notice signal indicating that the operation order is now highest to the indoor unit controller.

(4) Only when a predetermined response signal has responded to the notice signal sent at (3), the outdoor controller 13 executes the control operation described at (2).

Figure 6:
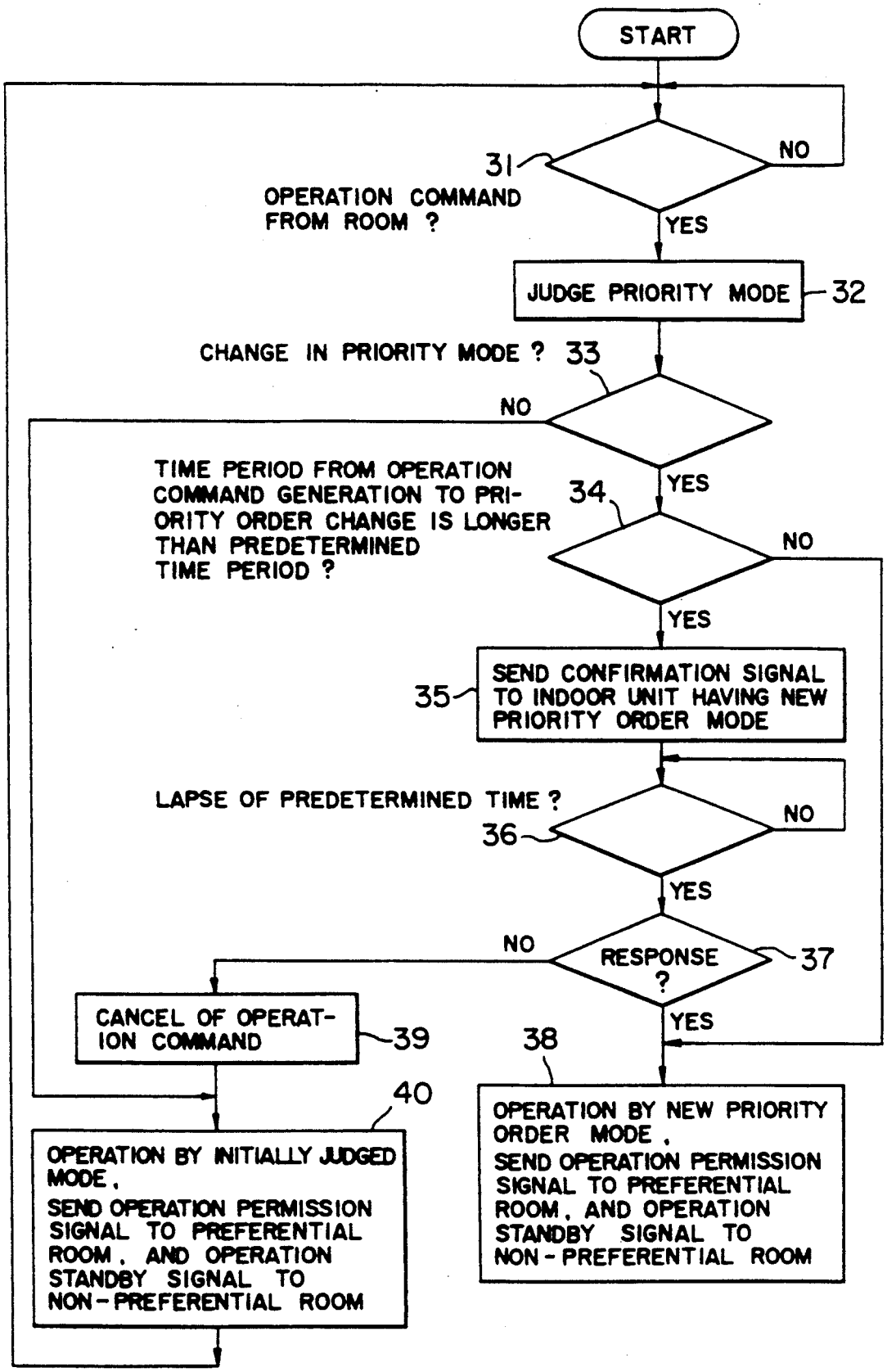
FIG. 6 is a flow chart used for explaining the control operation of the outdoor controller shown in FIG. 3.
Figure 7:
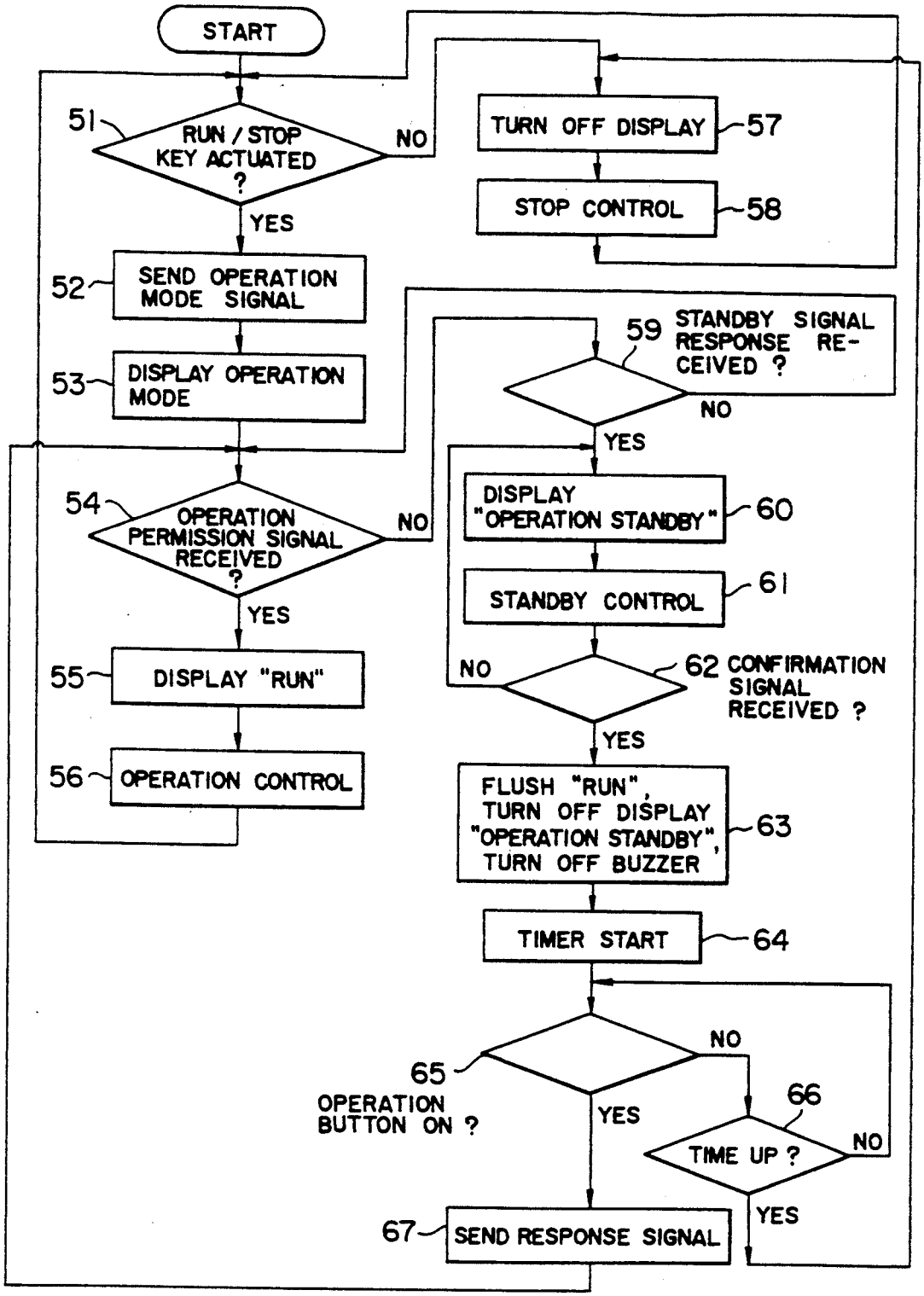
FIG. 7 is a flow chart used for explaining the control operation of an indoor controller shown in FIG. 3.

The above control operations will be later described with reference to the flow charts of FIGS. 6 and 7.

Figure 4:
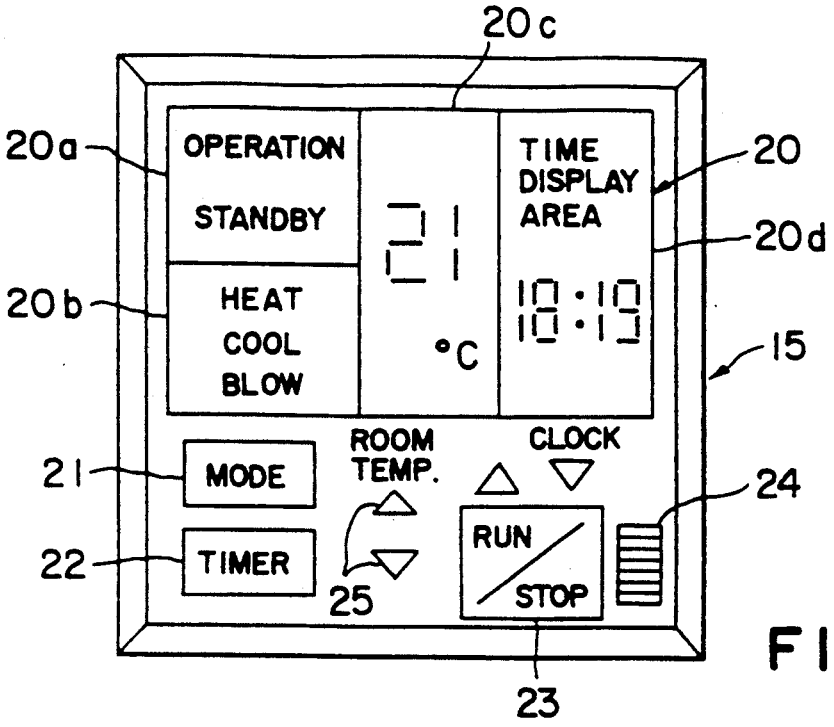
FIG. 4 is a plan view of a remote controller mounted on an indoor unit.

FIG. 4 shows a front view of one of the remote controllers 15a, 15b, and 15c equipped in each indoor controller 12a, 12b, 12c. Each of the remote controllers 15a, 15b, and 15c has the same structure and function, so in the following description the remote controller 15 will be described as being representative of them.

The remote controller 15 is equipped with a liquid crystal display 20, an operation mode setting key 21, a timer setting key 22, a run/stop command key 23, a buzzer 24, and a room temperature setting key 25. The liquid crystal display 20 is divided into an operation standby display area 20*a*, an operation mode display area 20*b*, a preset room temperature display area 20*c*, and a time display area 20*d*.

Figure 5A:
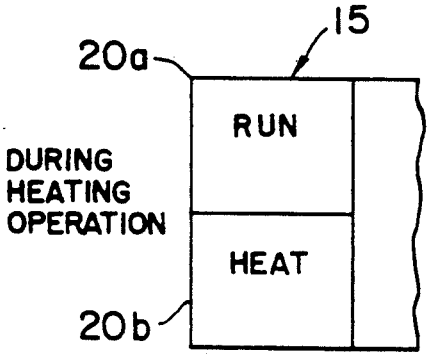
FIGS. 5A to 5D show examples of displays on the remote controller shown in FIG. 4.
Figure 5C:
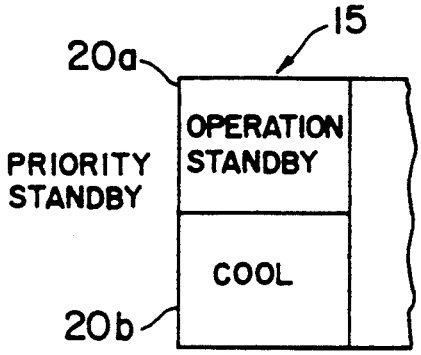
Figure 5B:
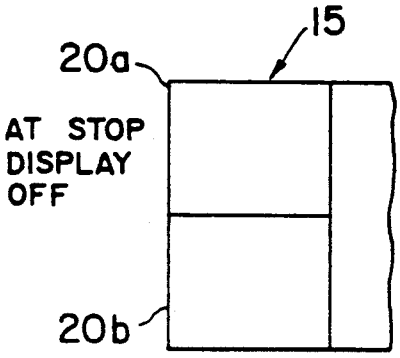
Figure 5D:
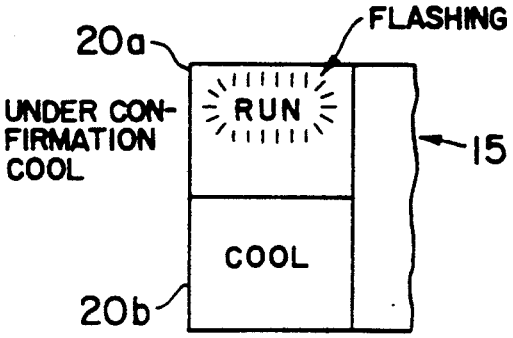

When the indoor unit is operating, an indication "RUN" is displayed on the operation standby display area 20*a* of the remote controller 5 as shown in FIG. 5A. When the indoor unit does not give an operation command (manually given by the run/stop command key 23) and in a completely stopped state and not in a so-called priority standby state, no indication is displayed as shown in FIG. 5B. If the indoor unit is given an operation command and set with an operation mode having a priority order other than the highest order, then the indication "OPERATION STANDBY" is displayed on the operation standby display area 20*a* as shown in FIG. 5C to notify the so-called priority standby state. When the indoor unit is released from the so-called priority order and takes the highest priority order, the outdoor controller sends the notice signal to the indoor controller and a character string "OPERATION" is flushed as shown in FIG. 5D.

When an operation mode set by the operation mode setting key 21 is determined as having the highest priority order, this operation mode is displayed on the operation mode display area 20*b*. For example, if an operation mode set by the operation mode setting key 21 is for a heating operation and has the highest priority order, then a character string "HEAT" is displayed on the operation mode display area 20*b* as shown in FIG. 5A. If the indoor unit is in a completely stopped state, no indication is displayed on the operation mode display area 20*b* as shown in FIG. 5B. If the indoor unit is in the so-called priority order standby state (FIG. 5C) or it has given a notice signal (FIG. 5D), the operation mode in the so-called priority order standby state, e.g., a cooling operation, is indicated by displaying a character string "COOL".

The room temperature set by the room temperature setting key 25 is displayed on the preset temperature display area 20*c*. On the time display area 20*d*, there is displayed a current time or a remaining operation time of the indoor unit set by the timer set key 22. The operation mode setting key 21 is manually operated to selectively set an operation mode. The timer setting key 22 is manually operated to set an operation time of the indoor unit. The run/stop command key 23 is manually operated to give an operation command to the indoor unit not under operation, or to give a stop command to the indoor unit under operation. The buzzer 24 is driven by the notice signal given to the indoor controller from the outdoor controller, when the indoor unit in the so-called priority order standby state takes the highest priority order.

Next, the control operation of the outdoor controller 13 will be described with reference to the flow chart shown in FIG. 6. In the following description, it is assumed that "HEAT" is set as the highest priority operation mode, and "COOL" is set as the next highest priority operation mode, respectively, in the outdoor unit 6.

As an operator turns on a power source of the air conditioner, the indoor controllers 12*a*, 12*b*, and 12*c* and the outdoor controller 13 enter a standby state. The outdoor controller checks if any one of the indoor controllers 12*a*, 12*b*, and 12*c* has sent an operation command signal. It is assumed that the indoor controller 12*a* has sent a heating operation command and the indoor controller 12*b* has sent a cooling operation command. The outdoor controller 13 confirms the sent commands (step 31) and judges which one of the operation command is to be preferentially selected (step 32). As described previously, the highest operation priority order is assigned to the heating operation, and the next highest operation priority order is assigned to the cooling operation. Therefore, it is determined that the indoor unit 10*a* is most preferentially operated and the indoor unit 10*b* is next preferentially operated. The outdoor controller sends an operation permission signal to the indoor controller 12*a* of the indoor unit 10*a*, and an operation standby signal is sent to the indoor controller 12*b* of the indoor unit 10*b*. As a result, the operation standby display area 20*a* and operation mode display area 20*b* of the remote controller 15*a* of the indoor unit 10*a* become as shown in FIG. 5A, whereas those of the indoor controller 15*b* of the indoor unit 10*b* becomes as shown in FIG. 5C. The indoor unit 10*a* having the highest priority order continues its heating operation unless the run/stop command key 23 of the remote controller is operated or unless the operation mode setting key 21 is operated and the operation mode is changed to a lower priority order. Namely, the operation permission signal is sent to the indoor controller 12*a*, and the operation standby signal is sent to the indoor controller 12*b* (steps 33 and 40). If it is confirmed at step 32 that the indoor unit 10*a* has sent an operation stop command or the operation mode has changed to a lower priority order, the priority order of the indoor unit 10*b* initially determined as the next highest order is changed to the highest priority order (step 33). It is judged if the lapse time from when the indoor controller 12*b* of the indoor unit 10*b* sent the cooling operation command to when the indoor controller 12*b* of the indoor unit 10*b* took the highest priority order at step 33, (i.e., if the time period while the indoor unit 10*b* is under the so-called priority order standby state), is longer than a predetermined standard time period (step 34). If it is judged at step 34 that the lapse time is not longer than the standard time period, the control immediately skips to step 38. At this step 38, an operation permission signal is sent to the indoor controller 12*b* for permitting the indoor unit 10*b* to perform a cooling operation, and an operation standby signal is sent to another indoor controller having a different operation mode. The reason for this is that if the time period while the indoor unit 10*b* is in the priority order standby state is not longer than the standard time period, it can be considered that a person has not left room B nor slept, or the environmental conditions of the indoor controller 12*b* have changed greatly from the conditions when the cooling operation command was issued.

On the other hand, if it is judged at step 34 that the lapse time became longer than the standard time period, there is a high possibility that a person has left room B or is sleeping, or the environmental conditions of the indoor controller 12*b* will have changed greatly from the conditions when the cooling operation command was issued. Accordingly, the outdoor controller 13 sends a notice signal to the indoor controller 12*b*, the notice signal being representative of that the indoor unit 10b has now the highest operation priority order. As a result, the operation standby display area 20a and operation mode display area 20b of the indoor unit 10b become as shown in FIG. 5D. At this time, the buzzer 24 of the remote controller 15b is driven so that an alarm is notified. It is checked if a predetermined response signal has been sent from the indoor controller 12b after a lapse of a predetermined time period shorter than the standard time after the time when the notice signal was sent to the indoor controller 12b at step 35 (steps 36 and 37). If it is confirmed at step 37 that the predetermined response signal has been sent, it is apparent that a person in room B still wishes to have a cooling operation. Accordingly, an operation permission signal is sent to the indoor controller 12b to permit the indoor unit 10b in room B to perform an operation under the cooling operation mode, and an operation standby signal is sent to another indoor controller having a different operation mode (step 38). If it is not confirmed at step 37 that the predetermined response signal has not been sent, it can be considered that the above-described case has occurred in room B. Therefore, the cooling operation command read from the indoor controller 12b at step 31 is canceled (step 39), and thereafter the control returns to step 31 via step 40.

Next, the control operation of the indoor controllers 12a, 12b, and 12c will be described with reference to the flow chart of FIG. 7. In the following description, the control operation of the indoor controller 12a of the indoor unit 10a of room A will be given. As an operator turns on a power source of the air conditioner, the indoor controllers 12a, 12b, and 12c and the outdoor controller 13 enter a standby state. When the indoor controller 12a confirms (at step 51) that the remote controller 15a has outputted a signal representative of that the run/stop command key 23 has been actuated and a signal representative of that the heating operation mode has been set by actuating the operation mode setting key 21, the indoor controller 12a sends a heating operation command signal to the outdoor controller 13 (step 52), and outputs a display command signal to display "HEAT" on the operation mode display area 20b of the remote controller 15a (step 53). Thereafter, it is checked if an operation permission signal has been outputted from the outdoor controller 13 (step 54). In this case, if the indoor unit 10b is under the cooling operation mode, the indoor unit 10a is allowed to be operated at the highest priority order. Therefore, the operation permission signal is sent from the outdoor controller 13 to the indoor controller 12a. The indoor controller 12a then outputs a display command signal to display "RUN" on the operation standby display area 20a of the remote controller 15a (step 55), and thereafter the indoor unit 10a operates under a predetermined operation control (in this case, under a heating operation control) (step 56).

If at step 54 the operation priority order of the outdoor unit 6 is being set in the order of cool, heat, and blow, and the indoor unit 10b is under the cooling 0 operation mode, then the indoor unit 10a is in the so-called priority order standby state. An operation standby signal is necessarily sent from the outdoor controller 13 unit (step 59). After confirming a reception of the operation standby signal from the outdoor controller 13, the indoor controller 12a outputs a display command signal to display "OPERATION STANDBY" on the operation standby display area 20a of the remote controller 15a (step 60). After step 60, a predetermined standby control is set to make the indoor unit 10a enter the operation standby state (step 61). After step 61, it is checked if a notice signal has been sent from the outdoor controller 13 after the operation order of the indoor unit 10a has changed to the highest priority order because the cooling operation of another indoor unit (e.g., indoor unit 10b of room B) having had the highest priority order has stopped or because the operation mode of the other indoor unit has changed to the lower priority order (step 62). If the notice signal has been received, the indoor controller 12a outputs a display command signal to the operation standby display area 20a to turn off an indication "OPERATION STANDBY" and flush an indication "RUN" (refer to FIG. 5D), and the indoor controller 122a also outputs a drive command signal to the buzzer 24 (step 63). Thereafter, a built-in timer of the indoor controller 12a is actuated (step 64). If a signal representative of an actuation of the run/stop command key 23 of the remote controller 15a is received before the time-up of the built-in timer (steps 65 and 66), a predetermined response signal is sent to the outdoor controller 13 (step 67) to execute a series of processing shown at steps 54 to 56.

On the other hand, if at step 64 the signal representative of an actuation of the run/stop command key 23 is not received before the time-up of the built-in timer (steps 65 and 66), the control returns to step 67. The reason for this is that there is a high possibility that a person has left room A or slept, or the environmental conditions of the indoor controller 12b have changed greatly from the conditions when the heating operation command was issued. Accordingly, a display command signal is outputted to the operation standby display area 20a to turn off an indication on the area 20a (step 57). The indoor unit 10a is caused to enter a complete stop state, not a so-called priority standby state described at step 61 (step 58). After step 58, the control returns to step 51. If a signal representative of an actuation of the run/stop command key 23 is not received at step 51, the control again goes to step 57. If it is judged at step 59 that an operation standby signal is not sent from the outdoor controller 13, the control executes the loop of steps 59, 54 and to 59. If it is judged at step 62 that a notice signal is not sent from the outdoor controller 13, the control executes the loop of steps 60, 61, 62, and to 60.

As described above, the embodiment of the present invention provides the following advantage. Specifically, it is assumed that the outdoor unit 6 sets the heating operation as the highest priority order operation mode, that the indoor unit 10a of room A has supplied a heating operation command, and that the outdoor controller 13 has supplied an operation permission signal to the indoor controller 12a. It is also assumed that the indoor controller 12a has supplied a signal representative of an operation stop or a signal representative of a change to a lower priority order operation mode. Under such a condition, if the operation inhibition time period of another indoor unit 10b which has been under the standby state until then, becomes longer than a standard time period, a notice signal is sent to the indoor controller 12b of the indoor unit 10b, informing that the operation order thereof has changed to the highest priority order. If a predetermined response signal is returned from the indoor controller 12b before a predetermined time period, an operation permission signal is given to the indoor controller 12*b*. As a result, when there arises a condition that a person has left room B or slept, or the environmental conditions of the indoor controller 12*b* have changed greatly from the conditions when a cooling operation command was issued, the operation of the indoor unit 10*b* can be inhibited without consuming unnecessary power, providing a reasonable operation of the whole system.

What is claimed is:

1. An air conditioner having at least two indoor units and a single outdoor unit commonly used by at least two indoor units, said air conditioner comprising:

first means for comparing operation commands sent from said at least two indoor units with a predetermined operation priority order, determining an indoor unit group allowed to be operated, and an indoor unit group not allowed to be operated, and sending an operation permission signal to each indoor unit of said indoor unit group allowed to be operated, and an operation standby signal to each indoor unit of said indoor unit group not allowed to be operated;

second means for determining a new indoor unit allowed to be operated within an indoor group having received said operation standby signal by referring to said operation priority order, in the case when said operation command of at least one indoor unit of said indoor unit group having received said operation permission signal sent from said first means is canceled, and sending a notice signal to said new indoor unit, said notice signal being used for confirming of the initial operation command of said new indoor unit is still effective or not;

third means for detecting a response signal sent from said new indoor unit after sending said notice signal from said second means; and fourth means for starting an operation of said new indoor unit when said response signal sent from said new indoor unit is detected by said third means.

2. An air conditioner according to claim 1, further comprising:

means for canceling said operation command of the indoor unit which does not supply said response signal within a predetermined time period from when said second means sent said notice signal.

3. An air conditioner having at least two indoor units and a single outdoor unit commonly used by at least two indoor units, said air conditioner comprising:

first means for comparing operation commands sent from said at least two indoor units with a predetermined operation priority order, determining an indoor unit group allowed to be operated, and an indoor unit group not allowed to be operated, and sending an operation permission signal to each indoor unit of said indoor unit group allowed to be operated, and an operation standby signal to each indoor unit to said operation priority order, in the case when said operation command of said indoor unit having received said operation permission signal sent from said first means is canceled, and starting an operation of said new indoor unit when a standby time of said new indoor unit is shorter than a predetermined time period;

third means for sending a notice signal to said new indoor unit when said standby time of said new indoor unit is longer than said predetermined time period, said notice signal being used for confirming if the initial operation command of said new indoor unit is still effective or not;

fourth means for detecting a response signal sent from said new indoor unit after sending said notice signal from said third means; and fifth means for starting an operation of said new indoor unit when said response signal sent from said new indoor unit is detected by said fourth means.

4. An air conditioner according to claim 3, further comprising:

means for canceling said operation command of the indoor unit which does not supply said response signal within a predetermined time period from when said third means sent said notice signal.

5. An air conditioner having at least two indoor units and a single outdoor unit commonly used by at least two indoor units: each of said indoor units comprising:

operation command means for sending an operation command in response to a manual operation;

operation control means for maintaining a standby state of an indoor unit when receiving an operation standby signal and for starting an operation of the indoor unit when receiving an operation permission signal;

notice means for giving notice indicating that an operation is allowed when a confirmation signal is received;

detection means for detecting if a response by a manual operation exist or not after giving notice from said notice means; and sender means for outputting a response signal when said response is detected by said detection means; said air conditioner comprising:

means for comparing operation commands sent from said at least two indoor units with a predetermined operation priority order, determining an indoor unit group allowed to be operated, and an indoor unit group not allowed to be operated;

means for sending said operation standby signal to each indoor unit of said indoor unit group not allowed to be operated;

means for judging if said each indoor unit of said indoor unit group allowed to be operated is in a standby state or not;

means for sending said operation permission signal to each indoor unit of said indoor unit group allowed to be operated, said each indoor unit being judged not to be in a standby state by said judging means;

means for sending confirmation signal to each indoor unit of said indoor unit group allowed to be operated and judged to be in a standby state by said judging means; and means for receiving said response signal sent from said indoor unit and sending said operation permission signal to the indoor unit from which said response signal is sent.

6. An air conditioner according to claim 5, further comprising:

means for cancelling said operation command of the indoor unit which does not supply said response signal within a predetermined time period from when receiving said confirmation signal.

7. An air conditioner having at least two indoor units and a single outdoor unit commonly used by at least two indoor units: each of said indoor units comprising:

operation command means for sending an operation command in response to a manual operation;

operation control means for receiving a standby signal, maintaining a standby state of the indoor unit in response to said operation standby signal, and starting an operation of the indoor unit in response to an operation permission signal;

notice means for giving notice indicating that an operation is allowed when a confirmation signal is received;

direction means for detecting if a response by a manual operation exist or not after giving said notice from said notice means; and sender means for outputting a response signal when said response is detected by said detection means; said air conditioner comprising:

means for comparing operation commands sent from said at least two indoor units with a predetermined operation priority order, determining an indoor unit group allowed to be operated, and an indoor unit group not allowed to be operated;

means for outputting a standby signal to each indoor unit of said indoor unit group not allowed to be operated;

timer means for measuring a lapse time in response to said operation standby signal outputted from said outputting means;

means for judging if each indoor unit of said indoor unit group allowed to be operated is in a standby state or not;

means for sending an operation permission signal to each indoor unit of said indoor unit group allowed to be operated, when said judging means judges that an indoor unit allowed to be operated is not in a standby state, or when said judging means judges that an indoor unit allowed to be operated is in a standby state and said lapse time measured by said timer means is shorter than a predetermined time period;

means for sending said confirmation signal to each indoor unit of said indoor unit group allowed to be operated, when said judging means judges that said indoor unit allowed to be operated is in a standby state and said lapse time measured by said timer means is longer than said predetermined time period; and means for sending said operation permission signal to an indoor unit in response to said response signal sent from said indoor unit.

8. An air conditioner according to claim 7, further comprising:

means for cancelling said operation command of the indoor unit which does not supply said response signal within a predetermined time period from when receiving said confirmation signal.

* * * * *

UNITED STATES PATENT AND TRADEMARK OFFICE

CERTIFICATE OF CORRECTION

PATENT NO. : 5,207,070

DATED : May 4, 1993

INVENTOR(S) : Koichi MIYAZAKI

It is certified that error appears in the above-identified patent and that said Letters Patent is hereby corrected as shown below:

Column 9:

Claim 3, line 10, after "unit" insert --of said indoor unit group not allowed to be operated;

second means for determining a new indoor unit allowed to be operated within an indoor unit group having received said operation standby signal by referring--.

Signed and Sealed this

Fifth Day of April, 1994

Bruce Lehman

BRUCE LEHMAN

*Commissioner of Patents and Trademarks*

*Attest:*

*Attesting Officer*